United States Patent [19]

Redman

[11] 4,281,961

[45] Aug. 4, 1981

[54] COIL TRANSFER APPARATUS

[75] Inventor: Howard E. Redman, Duxbury, Mass.

[73] Assignee: Mathewson Corporation, Quincy, Mass.

[21] Appl. No.: 941,774

[22] Filed: Sep. 13, 1978

[51] Int. Cl.[3] ..... B65G 47/90

[52] U.S. Cl. ..... 414/751; 198/953; 294/88; 294/103 R; 414/757; 414/225; 414/120

[58] Field of Search ..... 269/287, 289 MR; 198/953; 254/10.5; 29/173, 429, 430, 229, 240, 240.5; 140/3 CA, 103; 294/88, 86.12, 67 BA, 103 R, 103 CG; 414/749, 751, 120, 753, 744 A, 784, 757, 754, 225, 226, 622, 910, 911

[56] References Cited

U.S. PATENT DOCUMENTS

| | | | |
|---|---|---|---|
| 2,699,880 | 1/1955 | Haehn et al. | 414/622 |
| 2,714,969 | 8/1955 | Bartel et al. | 294/103 X |
| 2,980,233 | 4/1961 | Puccinelli | 414/753 X |
| 3,193,136 | 7/1965 | Stumpf et al. | 221/40 |
| 3,990,587 | 11/1976 | Redman | 414/753 X |
| 3,993,199 | 11/1976 | Jorgensen et al. | 414/757 |
| 4,105,188 | 8/1978 | Mendoza et al. | 254/10.5 |

FOREIGN PATENT DOCUMENTS

| | | | |
|---|---|---|---|
| 174563 | 7/1921 | United Kingdom | 269/287 |

*Primary Examiner*—Frank E. Werner
*Attorney, Agent, or Firm*—Robert T. Gammons

[57] ABSTRACT

A jaw for holding a coil in a coil transfer apparatus during movement from one position to another designed to permit the coil to be rotated about its longitudinal axis while held by the jaw.

11 Claims, 12 Drawing Figures

COIL TRANSFER APPARATUS

BACKGROUND OF THE INVENTION

In my U.S. Pat. No. 3,990,587, there is disclosed coil transfer apparatus for separating coils one-at-a-time from groups of coils and transferring them to a place for assembling in a coil spring assembly machine. During the course of transfer, the coils must be held not only for effecting the transfer, but also rotated about their longitudinal axes to position the knots at the ends of the coils in predetermined positions of orientation. In the aforesaid apparatus, there is a jaw arranged to take hold of a coil, withdraw it from a group of coils, move it in translation onto a rotor rotatable about a vertical axis to rotate the coil about its longitudinal axis and, following such rotation, transfer the coil to the place of assembly and, during such transfer, invert the coil end-for-end. While the coil is on the rotatable table, it is rotated about is vertical axis by a rotatable platform and necessarily during such rotation, the portion of the coil held by the jaw must be free to move in the jaw in spite of the engagement of the helice of the coil within the jaw. If the coils are relatively stiff, no problem exists with the apparatus described in the aforesaid patent. However, if the coils are of light gauge wire, the frictional resistance to rotational movement within the jaw is such that instead of the helix moving freely, the coil is actually wound about its longitudinal axis. Consequently, when the coil is finally released, it merely unwinds and, as a result, the knots of the successive coils are not properly oriented. The purpose of this invention is to provide an improvement in the coil holding jaw which will ensure rotation of the coil at the proper movement in its transfer, and hence, alignment of the knots in successive coils.

SUMMARY OF INVENTION

As herein illustrated, the invention resides in a coil transfer apparatus of a jaw defining a recess arranged to receive a segmental portion of a coil, a latch movable at right angles into the recess to retain the segmental portion therein and means carried by the latch for rolling engagement with the segmental portion to permit the coil to be turned about its axis while held in the jaw. The recess has spaced, parallel upper and lower surfaces and contains a gap midway between its ends. The latch has spaced, parallel surfaces perpendicular to the spaced parallel surfaces of the recess and between its spaced surfaces a roller. There is means supporting the latch for movement through the gap to a position of engagement of its spaced surfaces with the sides of the coil and of the roller with the bottom of the coil.

The invention will now be described in greater detail with reference to the accompanying drawings, wherein.

Figure 1:
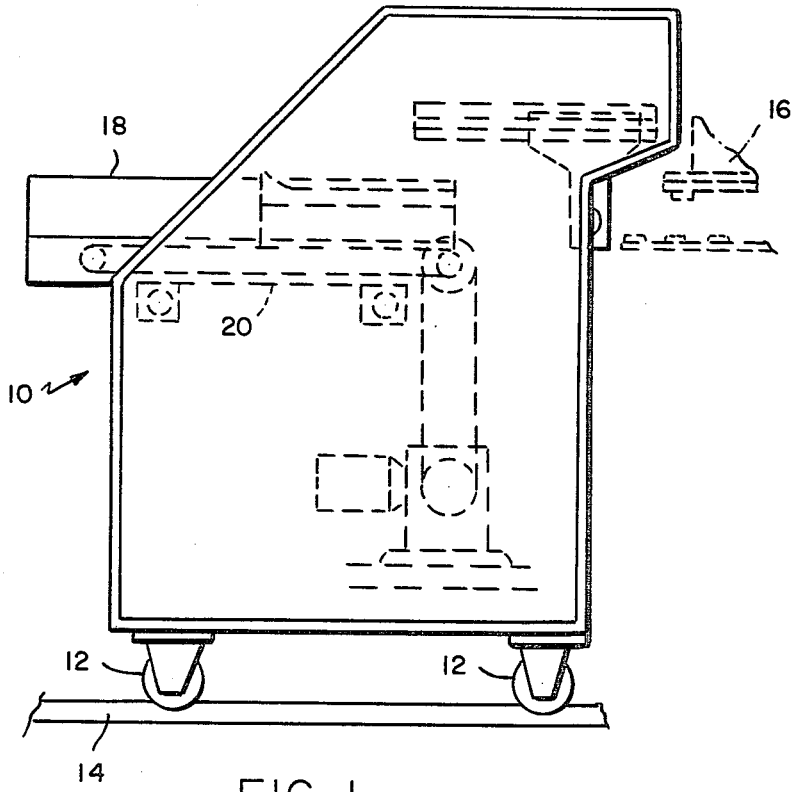
FIG. 1 is a side elevation of the coil separating and transferring apparatus of this invention.
Figure 2:
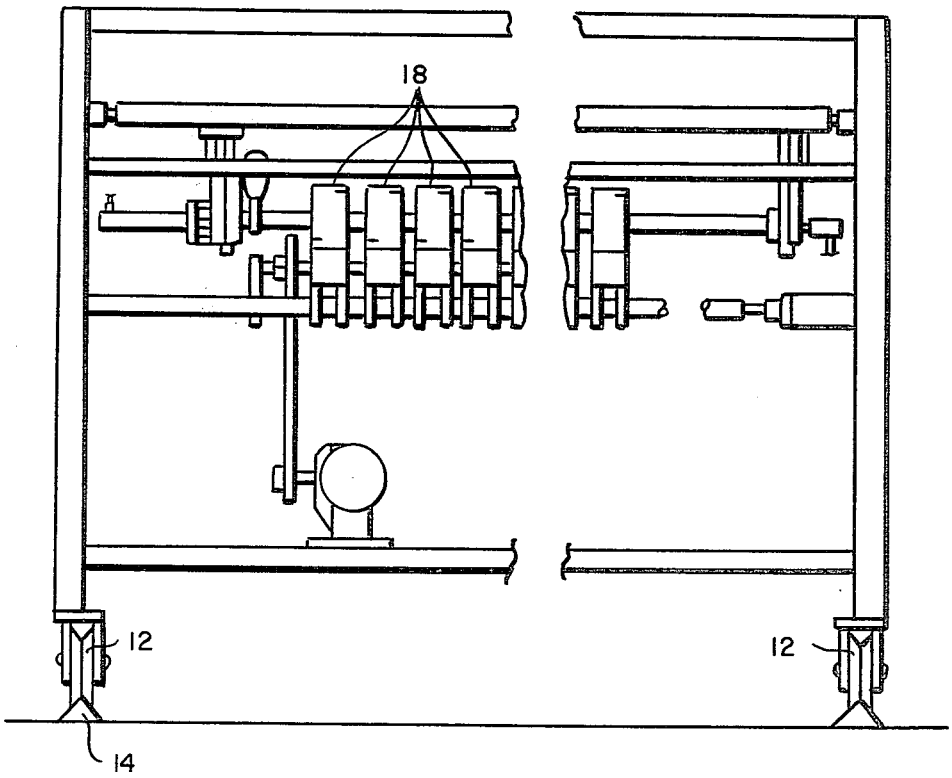
FIG. 2 is a front elevation as seen from the right side of FIG. 1.
Figure 3:
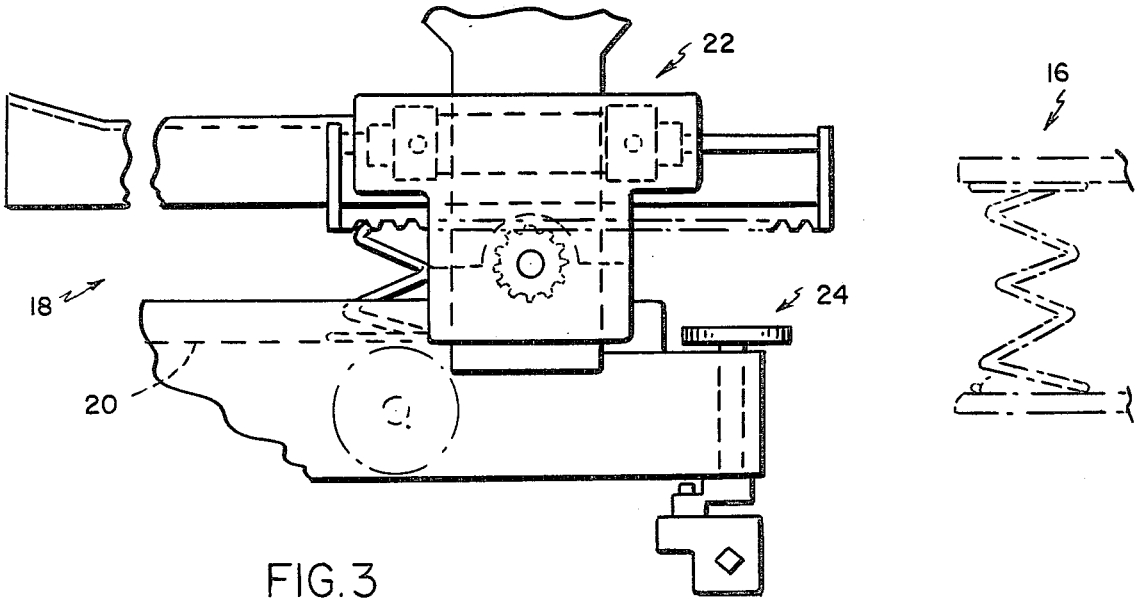
FIG. 3 is a fragmentary side elevation to a much larger scale showing the position of the coil orienting and transfer means in position for receiving a coil.
Figure 4:
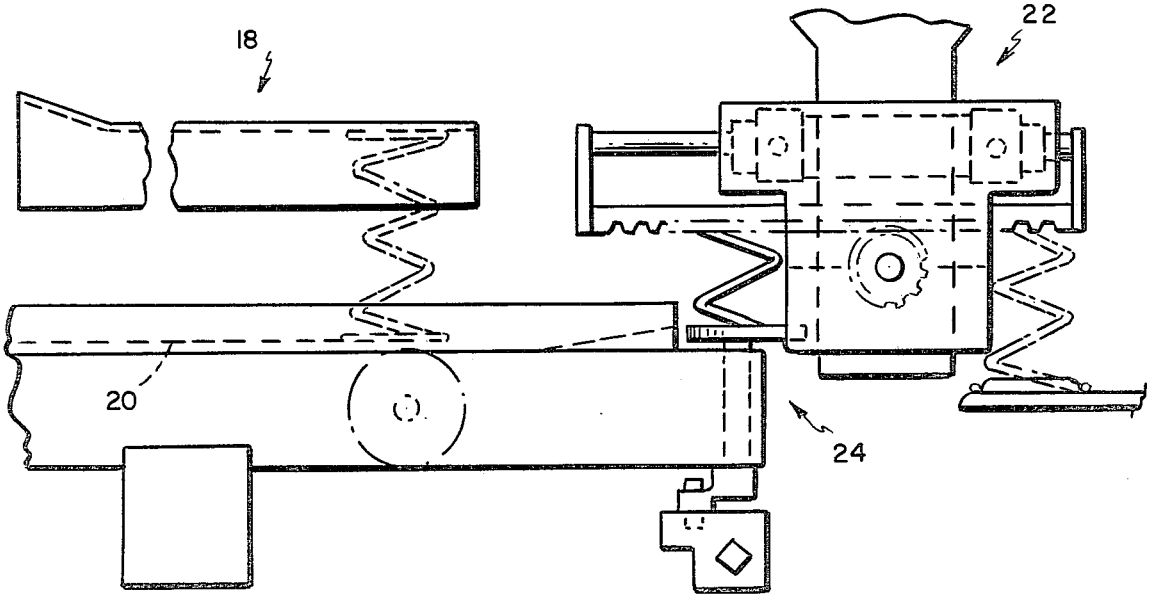
FIG. 4 is a side elevation of the coil orienting and transferring means following the separation of the leading coil in the transfer position.
Figure 5:
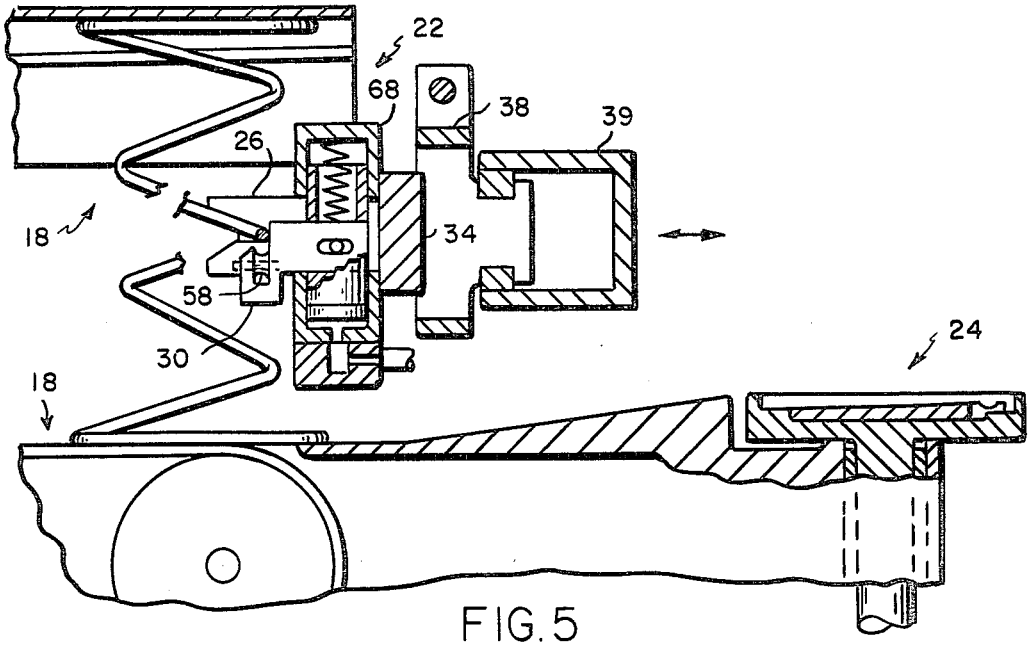
FIG. 5 is a fragmentary elevation to still larger scale showing the gripper assembly engaged with the coil for moving the coil onto the turntable for orientation.

Referring to FIGS. 1 and 2, there is shown coil transfer apparatus 10 mounted on supporting wheels 12 for movement along tracks 14 relative to a coil assembly apparatus 16. The purpose of the apparatus is to receive groups of coils, separate the individual coils from the groups, rotate them so as to dispose the knots at the upper and lower ends of the coils all in the same position, and present a transverse line of spaced coils to the spring assembly machine. For this purpose, the apparatus is provided with horizontally-disposed parallel magazines 18 for receiving batches of coils, each magazine being provided at its bottom with a conveyor 20 by means of which the coils are advanced along the magazine toward coil transporting means 22, FIGS. 5 to 11, the latter being adapted to take hold of the leading coil in any group of coils intermediate its upper and lower ends and extract it from the succeeding coils, move it onto a turntable 24, FIGS. 3, 4, 5, and 7, for rotation about its vertical axis to dispose the knots in predetermined positions of orientation, rotate it about a horizontal axis from the position shown at the left-hand side of FIGS. 3 and 4 and release it to the spring assembling machine 16. FIGS. 3 and 4 show movement of the coil from the position where it is grasped and separated from the group of coils in the magazine and onto the turntable 24 for rotation about its vertical axis, and FIG. 3 shows its rotation to the position of release to the spring assembly machine.

The coil transporting means in the aforesaid U.S. Pat. No. 3,990,587 was provided with a jaw containing a recess for receiving an arcuate portion of a coil and a hook plate rotatable about a horizontal axis for engagement with a helix of a coil within the recess to firmly hold the coil while being withdrawn from the group of coils onto the turntable for rotation about its vertical axis. A certain amount of clearance is provided in the hook by means of which the coil was engaged and held within the recess so that when the coil was drawn onto the turntable, it could be rotated about its vertical axis by slipping of the helices of the coil through the hook. This apparatus was perfectly satisfactory for coils of relatively heavy guage wire. However, it was found that with coils comprised of light guage wire, the friction of the hook in engagement with the wire was such that the wire, rather than slip, would merely be wound up and when later released at its position of inversion, the coil simply unwound with the result that the knots were not in positions of common orientation. The transporting means 22, accordingly, have been redesigned, as herein illustrated, to enable transporting of the coil to the turntable in such a way as to enable it to be turned freely about its vertical axis. As herein illustrated, the transporting means comprises essentially a jaw 26 defining an arcuate recess 28 and a latch 30 supported below the jaw 26 and movable upwardly into the recess to retain the helix of a coil seated within the recess 28. The jaw 26 comprises two jaw blocks 32—32 welded to and extending forwardly in spaced parallel relation to a rigid plate 34 containing at its opposite ends arcuate openings 36—36 by means of which it is bolted to the beam 38 of the transfer carriage 39. The forward end of each jaw contains a portion of the arcuate recess 28. As indicated, the back of the recess has a curvature which corresponds substantially to the curvature of the helix of the coil defined by spaced, parallel top and bottom surfaces 40—40. Converging surfaces 42—42 lead into the recess. The jaw blocks 32—32 being spaced define between them a gap 44 and the latch 30 is mounted so as to be movable from below the recess upwardly through the gap 44 to a position to capture and engage the helical section of the coil seated within the recess. The latch 30 comprises a block having spaced fore and aft portions 46 and 48, the latter being provided with an arm 52 by means of which it is mounted in a gap between shoulders 50—50 at the rear side or back of the gap. A hole 54 is provided through the fore and aft portions 46 and 48 for receiving a spindle 56 and grooved roller 58 is rotatably mounted on the spindle between the fore and aft portions.

When an arcuate portion of a coil is seated in the arcuate recess 28 and the latch 30 is moved upwardly into the gap, the spaced, parallel surfaces 47, 49 of the fore and aft portions engage, respectively, the opposite sides of the helix and the grooved roller 58 engages the bottom side, thus retaining the coil in the recess, but permitting it to move laterally therein relatively freely because of the fact that the grooved roller 58 can turn freely.

The arm 52 containing an elongate slot 60 and a horizontally-disposed screw bolt 62 mounted transversely of the jaw blocks 32—32 provides for adjusting the latch 30 and, hence, the roller 58 forwardly and rearwardly with respect to the recess 28.

As heretofore explained, the latch 30 is movable from a position below the jaw to a position into the gap 28 between the jaw block to effect trapping a coil. To this end, the arm 52 is fixed to a piston 66 vertically slidable in a cylinder 68 formed partly in the confronting sides of the jaw blocks 32-32 and partly in cap blocks 68—68 bolted to the upper and lower sides of the jaw blocks 32—32. The part of the piston in the upper end of the cylinder is axially bored to receive a spring 70 for holding the piston depressed. A port 72 is provided in the lower end of the cylinder through which air pressure is adapted to be supplied to raise the piston and, hence, the latch into operative position. Normally, the latch 30 is held depressed by the coil spring 70.

Figure 6:
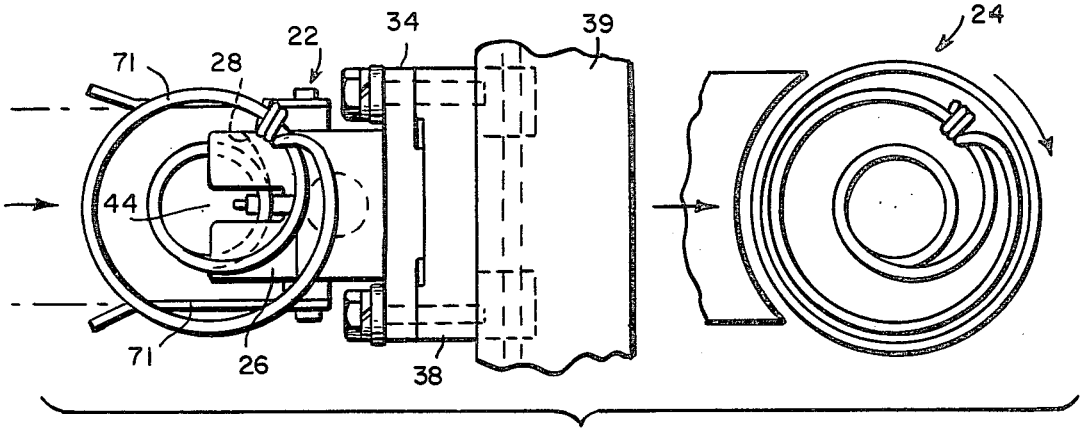
FIG. 6 is a plan view of FIG. 5.
Figure 7:
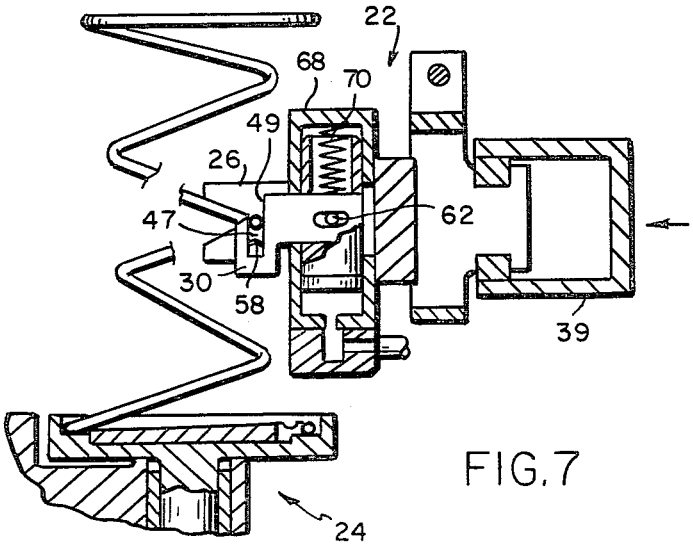
FIG. 7 is a fragmentary elevation showing the coil drawn onto the turntable.
Figure 8:
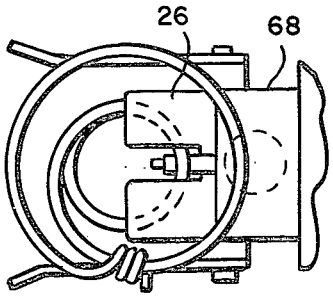
FIG. 8 is a plan view of FIG. 7.
Figure 10:
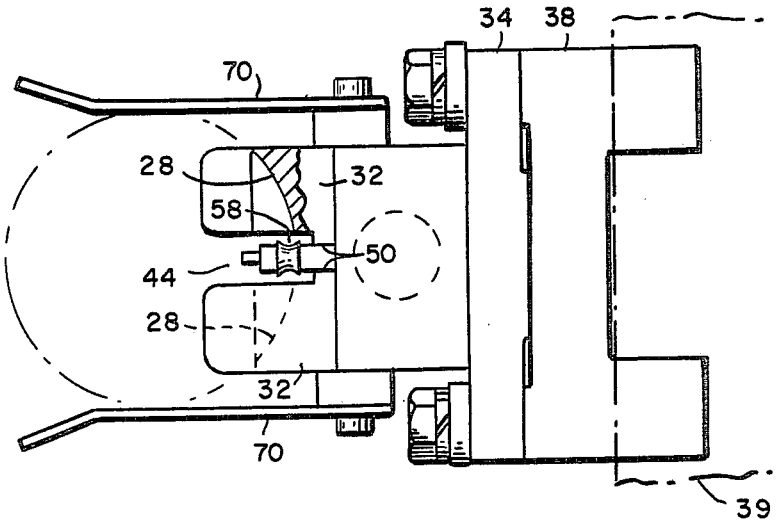
FIG. 10 is a plan view of FIG. 9.
Figure 9:
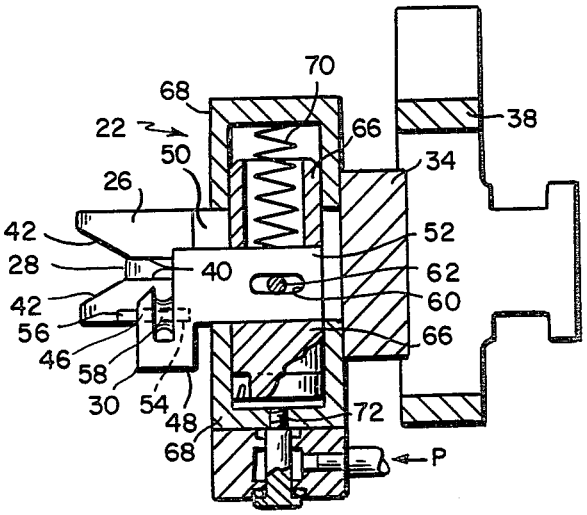
FIG. 9 is a section of the gripper assembly.
Figure 11:
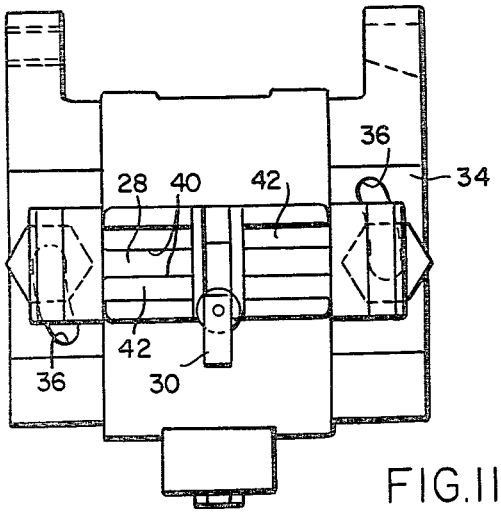
FIG. 11 is an elevation as seen from the left side of FIG. 10.
Figure 5A:
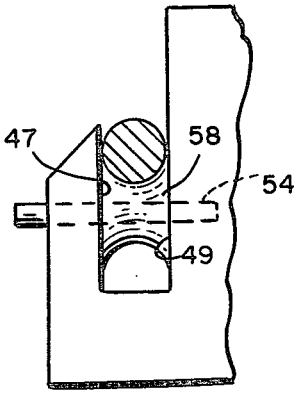
FIG. 5A is an enlarged fragmentary section of the latch means.

To facilitate guiding the coil into the recess, there are provided transversely spaced spring fingers 71—71, FIGS. 6 and 10.

The device as thus constructed is of relatively simple construction, more effective than that shown in the aforesaid patent because its movement is rectilinear rather than arcuate so that whatever the pull is, there is no tendency to rock it away from engagement with the wire and, finally, because it enables lateral movement of the wire within the closed jaw so that light guage coils can be rotated about their vertical axes without twisting them. Where the apparatus of the patent will handle a $13\frac{1}{2}$ gauge wire, the apparatus of this invention is required to handle $14\frac{1}{2}$ gauge wire.

It should be understood that the present disclosure is for the purpose of illustration only and includes all modifications or improvements which fall within the scope of the appended claims.

I claim:

1. In a coil transfer apparatus, a jaw arranged to take single coils successively from a group of coils and present them one-by-one to an assembly machine and wherein the coil during transport is rotated about its longitudinal axis, said jaw defining an arcuate recess for receiving an arcuate portion of the helix of the coil to be transferred, said recess containing a gap midway between its ends, a part and means supporting the part for movement through the gap into the recess behind the arcuate portion of the helix therein to retain the coil for transfer, said part comprising a block supported in the gap for movement from a position below the recess upwardly through the gap into the recess, said block having spaced coil-retaining surfaces for engagement with the inner and outer sides of the arcuate portion of the coil in the recess, a roller mounted between said surfaces for engagement with the lower side of the arcuate portion of the coil in the recess and means for moving the block upwardly into the gap to capture a coil while permitting the coil to turn about its longitudinal axis within the jaw.

2. Apparatus according to claim 1 wherein there is means yieldably holding the part below the recess and means for moving the part into the recess to retain the helix of the coil in the recess.

3. Apparatus according to claim 1 wherein the roller is mounted to the part for movement therewith and for rotation about an axis perpendicular to a tangent to the recess.

4. In a coil transfer apparatus, a jaw for receiving a coil from a group of coils and means supporting the jaw for movement in a direction to remove the coil from the group of coils and transfer it to an assembly machine, said jaw being designed to enable turning the coil about its longitudinal axis during the transfer and to this end comprising a part containing an arcuate recess for receiving an arcuate portion of the coil, a retainer movable into the recess behind the arcuate portion of the coil and a roller supported by the retainer and movable therewith into engagement with the arcuate portion of the coil so as to have rolling engagement therewith, and wherein the part defining the arcuate recess has spaced, parallel surfaces for engagement with the top and bottom sides of the arcuate portion of the coil received therebetween, the retainer has spaced, parallel surfaces perpendicular to the spaced, parallel surfaces of the recess for engagement with the inner and outer sides of the arcuate portion of the coil and the roller is mounted between the surfaces of the retainer.

5. Apparatus according to claim 4 wherein there is means for adjustably mounting the part to the support for adjustment to the helix of the coil.

6. Apparatus according to claim 4 wherein there is means mounting the retainer on the support for adjustment radially with respect to the recess.

7. Apparatus according to claim 4 wherein there is spring means which holds the part depressed below the gap and an air-operated piston for raising it to its operative position.

8. Apparatus according to claim 4 wherein the part has spaced converging surfaces leading into the recess.

9. Apparatus according to claim 4 wherein there are transversely-spaced guide fingers fixed to the support at opposite sides of the part at a spacing corresponding to the diameter of the coil.

10. In a coil transfer apparatus, means defining a recess having a concavely-arcuate surface and first spaced, parallel surfaces symmetrically positioned and perpendicular to the axis of the arcuate recess for receiving an arcuate portion of a coil, a latch member movable into the recess to close a portion of the open side thereof to thereby retain the coil in the recess, said latch defining second spaced, parallel surfaces perpendicular to the first spaced, parallel surfaces with one of said spaced, parallel surfaces tangent to the arcuate surface and the other spaced therefrom, said spaced, parallel surfaces defining in conjunction an enclosure within the recess for capturing the coil and a freely-rotatable roller supported between the second spaced, parallel surfaces for rotation about an axis parallel to the first spaced, parallel surfaces, said roller defining one side of the enclosure.

11. In a coil transfer apparatus, a jaw arranged to take single coils successively from a group of coils and present them one-by-one to an assembly machine and wherein the coil during transport is rotated about its longitudinal axis, said jaw defining an arcuate recess for receiving an arcuate portion of the helix of a coil to be transferred, said recess containing a gap midway between its ends, means movable parallel to the axis of the coil at right angles to the recess into the recess into engagement with the arcuate portion of the helix of the coil situated within the recess to clampingly retain the coil within the jaw, said means comprising a roller containing a peripheral groove of half round section for receiving substantially half the diametral thickness of the wire of the coil, means supporting the roller on said first means for rotation about an axis perpendicular to the axis of the coil into the gap so that the groove of the roller has tangential engagement with the arcuate portion of the helix of the coil situated within the groove, said roller permitting the coil to turn about its longitudinal axis while constrained within the jaw and means for effecting reciprocal movement of the first-named means for at times clamping a coil in the jaw and at other times releasing the coil from the jaw.

* * * * *